United States Patent [19]

Anderson

[11] 4,180,469

[45] Dec. 25, 1979

[54] DITHIOCARBAMATE SULFONIUM SALT INHIBITOR COMPOSITION

[75] Inventor: James D. Anderson, Ambler, Pa.

[73] Assignee: Amchem Products, Inc., New York, N.Y.

[21] Appl. No.: 866,052

[22] Filed: Dec. 30, 1977

[51] Int. Cl.[2] ..... C11G 1/06

[52] U.S. Cl. ..... 252/149; 252/79.4; 252/151; 252/390; 252/391; 252/394; 252/395; 134/3; 134/41; 252/180; 252/80

[58] Field of Search ..... 252/149, 151, 79.4, 252/390, 391, 394, 395, 180, 80; 134/3, 41

[56] References Cited

U.S. PATENT DOCUMENTS

| | | | |
|---|---|---|---|
| 2,734,869 | 2/1956 | Mullen, Jr. et al. | 252/391 X |
| 2,941,949 | 6/1960 | Saukaitis | 252/151 |
| 2,959,555 | 11/1960 | Martin et al. | 252/149 |
| 3,074,825 | 1/1963 | Gardner | 252/391 X |
| 3,819,527 | 6/1974 | Hayman, Jr. | 252/149 |
| 3,907,699 | 9/1975 | Blair | 252/149 |

*Primary Examiner*—Mayer Weinblatt
*Attorney, Agent, or Firm*—Dale Lynn Carlson

[57] ABSTRACT

Compositions comprising mixtures of a dithiocarbamic acid derivative and a sulfonium compound such as triphenylsulfonium chloride provide effective corrosion inhibition in acid treatment of metal in the presence of a copper complexing agent such as a thiourea.

5 Claims, No Drawings

DITHIOCARBAMATE SULFONIUM SALT INHIBITOR COMPOSITION

FIELD OF THE INVENTION

This invention pertains to compositions for use as corrosion inhibitors in acid cleaning, acid pickling and similar acid treatments of metal. In particular, this invention pertains to a synergistic combination of organic sulfur-containing compounds which together can be effectively utilized as an additive to acid cleaning solutions, particularly, those utilizing hydrochloric acid and a copper complexing thiourea for cleaning industrial systems subject to accumulations of water-insoluble deposits on the metal surfaces.

Acid cleaning operations are commonly employed to remove adhering substances such as mill scale and fly ash from the inner surface of vessels, tubes and related industrial processing equipment, particularly, where such equipment is fabricated from ferrous metals. In service equipment for aqueous processing, especially at high temperatures, tends to build up insoluble deposits which require periodic removal. In such cases, acid cleaning is used for example to remove lime deposits or water scale from power plant boilers and piping systems and from evaporating equipment as well as to remove scale and deposits from processing equipment in such plants as refineries, utility companies, paper mills, chemical plants and similar industrial operations. Since the acid tends to remove a portion of the basis metal with each cleaning, the use of inhibitors to reduce basis metal loss in acid cleaning can substantially extend the life of such industrial equipment.

Similar acid cleaning solutions are also used in acid pickling for the removal of undesirable oxide coatings from metals, usually ferrous metals, before subjecting them to further treatments such as phosphate coating, enameling, electroplating and the like.

Among the acids generally used for industrial cleaning the inorganic acids, particularly, the mineral acids such as hydrochloric, sulfuric, nitric, and phosphoric acid are most frequently used, though others are also used depending upon the particular needs. In still other cases, organic acids including formic acid, citric acid, mixtures of hydroxy acetic and formic acids, and acetic acid and other organic acids, such as, oxalic acid, tartaric acid and alkylene polyamine carboxylic acids as well as water soluble salts and mixes of acids and salts are used.

Perhaps the most widely used acid for chemical cleaning is hydrochloric acid, particularly, when used for the removal of scales and other unwanted deposits from steam generating equipment and from chemical and petrochemical reaction vessels.

Hydrochloric acid solutions are also used in oil well acidizing wherein large quantities are pumped at high rates of flow through the oil well into the oil producing formation. The acid concentrations are usually high, in the order of 10% to 15% by weight and the temperatures at the bottom of the well are also high creating situations for severe corrosion of the oil well tubing by the attack of the hydrochloric acid on the metal.

In order to reduce or prevent loss of metal from industrial equipment in industrial cleaning operations and in oil well acidizing and similar operations and to prevent loss of metal in pickling operations where acid treatments are used to remove undesirable processing scale and oxide coatings, acid inhibitors are extensively used as additives to the cleaning, acidizing or pickling solutions employed in these operations. Over the years, a wide variety of inhibitors have been developed and selection of a particular inhibitor will vary according to the type of acid used in the operation, the particular metal substrate and other considerations. Mixtures of inhibitors have also found considerable interest among those employing acid treatments for metal cleaning and the like, particularly, inhibitors which in combination produce an apparent synergistic effect.

However, the complexity of the inhibition phenomena is such that there are no particular criteria by which one can predict the inhibiting power or degree of inhibition that can be achieved with any particular inhibitor or combination under particular circumstances and in some instances a combination of inhibitors may result in a decrease in the inhibiting strength.

Where inhibitors are involved in protecting metals in the presence of acids, the metal involved is generally one of the various steel alloys. Other metals are occasionally involved, particularly, in the case of valves and fittings. Among the other metals that are involved are copper, aluminum, nickel, and nickel alloys and some of the exotic metals such as titanium, zirconium and tantalum. Generally, however, work with inhibited acids in industrial situations involves working with steel and, to a very large extent, carbon steel or mild steel.

DESCRIPTION OF THE PRIOR ART

The art recognizes a variety of materials used as inhibitors. Some of the earliest inhibitor systems used were inorganic materials though in recent years the trend has been to utilize organic compounds. There does not appear to be any recognized basis for correlating chemical structure to inhibiting strength but a number of suitable inhibitors have been found generally among the organic amines and the organic thio compounds and these appear to be predominant in use. The nitrogen containing compounds or amines have been found to be particularly effective as inhibitors in hydrochloric acid; though certain thio compounds or sulfur containing compounds have also been found to be of value. The thio compounds, however, tend to be used more frequently in conjunction with sulfuric acid.

Among the thio compounds, the thioureas are well known as inhibitors and components of inhibitors for many acid systems but they are not generally satisfactory for organic acids unless blended with organic bases. See for example U.S. Pat. Nos. 2,403,153; 2,807,585; and 2,561,510. However, the nitrogen bases used in producing inhibitor blends might be objectionable at times, particularly, because of their tendency to form undesirable deposits on the metal surface.

It is also well known that urea derivatives, particularly thiourea and a number of substituted thioureas and thiourea derivatives, are useful for removing metallic copper from scale components when used in hydrochloric acid solutions. The thioureas when used with acid cleaning solutions prevent the redeposition of copper dissolved from boiler scale and the like. However, when thiourea is used in this way for scale and copper removal, the acid is excessively corrosive to the basis metal or steel. It has even been shown that under certain conditions, thiourea is actually an accelerator of corrosion in acid solutions. This is particularly true in the case of hydrochloric acid solutions. For this reason, extensive efforts have been directed to investigating suitable inhibitors for hydrochloric acid, particularly when used with a thiourea copper-complexing agent. Among the inhibitors suggested for use with acid/thiourea cleaning solutions, U.S. Pat. No. 2,959,55 states that the organic nitrogen type are preferred.

Triphenylsulfonium chloride is also known as an inhibitor and as a component of inhibitors for sulfuric, phosphoric, hydrochloric, sulfamic, hydrofluoric, and fluosilicic acids among others. (See for example U.S. Pat. No. 2,941,949). This inhibitor, however, is more effective when combined with other appropriate inhibitors and combinations with organic amines and propargyl alcohol are known, among others.

Certain dithiocarbamate salts and esters have also been previously disclosed for use as inhibitors though the dithiocarbamates are not utilized as acid inhibitors and are not known to be effective inhibitors in hydrochloric acid/thiourea cleaning solutions; nor are the dithiocarbamates generally considered for use in combination with other inhibitors particularly sulfonium salts and thioureas. U.S. Pat. No. 2,723,232 which discloses the use of dithiocarbamate salts as inhibitors in certain environments also states that the dithiocarbamic acid salts function in a corrosive environment in which direct acid attack upon the ferrous metal is a minor factor. Thus, the dithiocarbamates appear as unlikely candidates for inhibitor blends in industrial acid cleaning.

Though it is common practice to blend two, three or more known inhibitors in an effort to provide acid inhibition suitable to specific conditions, the instances where such blends produce an inhibitor combination of unexpectedly enhanced inhibition strength are rare. Nonetheless, the phenomena of synergism has long been recognized in the use of inhibitors in acid solutions and synergistic combinations are an important tool in development of acid inhibitors for specialized uses. Those few synergistic combinations which are known generally involve an amine as one of the essential components. One of the earliest known examples of synergism in acid inhibitors, is the amine/thiourea combination. When used in sulfuric acid as a pickling inhibitor, amines are not effective and thioureas have only moderate value. However, the combination of amines and thioureas produces an effective inhibitor combination for sulfuric acid pickling. Another instance in which an amine is essential is the combination of acetylenic alcohols and nitrogen compounds in hydrochloric acid. Both inhibitors are only reasonably effective when used alone, but together they provide an excellent inhibitor. Still another example of a synergistic combination also involving an amine can be found in U.S. Pat. No. 3,382,179 wherein an acetylenic compound, an amine and naphthenic acid are combined to provide a synergistic combination. The sulfonium compounds have also been frequently used in inhibitor blends with propargyl alcohol or amines though not as a component of a synergistic combination involving two or more thio compounds as an inhibitor for hydrochloric acids.

The excessive loss of basis metal experienced when thiourea or a thiourea derivative is used as a copper complexing agent in hydrochloric acid cleaning solutions for removing water scale from boilers, evaporators and the like, notwithstanding the presence of known acid inhibitors has become a severe problem as the cost of replacing equipment has escalated. A new inhibitor or significantly more effective combination is much needed. The metal loss experienced with the best currently available inhibitors, including known inhibitor combinations, used for industrial cleaning with hydrochloric acid and thiourea is on the order of 0.01 lb. per square foot of surface in 24 hours of exposure. The industry goal has been set at less than 0.005 lbs/sq ft/24 hours.

Accordingly, it is an object of this invention to provide an acid cleaning solution with increased inhibiting strength thereby reducing the loss of basis metal during scale removal and cleaning operations. Another object of this invention is to provide novel acid inhibitor combinations of greater inhibiting power than could be achieved heretofore. It is a further object of this invention to provide inhibitor combinations which when used in hydrochloric acid cleaning with a urea derivative provide a substantial reduction in metal loss. Still other objects and advantages will be apparent from the description of the invention which follows.

SUMMARY OF THE INVENTION

This invention provides a novel acid inhibitor combination which is particularly useful for chemical cleaning with solutions of hydrochloric acid and thiourea. The combination comprises a sulfonium salt preferably triphenylsulfonium chloride and a dithiocarbamate preferably benzyl-N-methyl dithiocarbamate in a preferred ratio of about 1 part by weight of benzyl-N-methyl dithiocarbamate for each 2 to 3 parts by weight of triphenylsulfonium chloride.

DESCRIPTION OF THE PREFERRED EMBODIMENTS

In accordance with this invention, it has been found that a combination of: (A) an acid inhibitor of the sulfonium salt type and (B) a dithiocarbamic acid or derivative thereof such as an ester or salt of dithiocarbamic acid has unusually high inhibiting strength in hydrochloric acid cleaning solutions containing a urea derivative as a copper complexing agent. As will be more fully described below, the two component acid inhibitor combination can be provided as a single stable composition and it is to be understood that whenever reference is made to the composition, the results can be achieved by adding the two components separately or as a combination along with other additives. The combination has been found to be particularly effective where the use of thiourea or a thiourea derivative is a necessary additive for hydrochloric acid cleaning even though it may increase the severity of attack on the basis metal which is usually mild steel, i.e. carbon steel. Thus, as one embodiment, the invention can be viewed as comprising a three component inhibitor composition in which the third component is thiourea or a substituted thiourea or thiourea derivative.

As the essential sulfonium salt component of the composition of this invention there can be utilized any of the well known sulfonium inhibitor compounds particularly those of the formula:

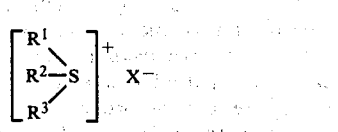

I wherein $R^1$, $R^2$, and $R^3$ are each a hydrocarbon radical, such as for example, those selected from the group consisting of alkyl, aryl and aralkyl and alkaryl, wherein X is an acid anion, preferably an anion of a strong mineral acid. Formula I above includes within its scope compounds wherein the $R^1$, $R^2$ and $R^3$ radicals may be the same or different.

Formula I above includes also compounds wherein one or more of the $R^1$, $R^2$, and $R^3$ radicals contain one or more of the same or different substituents examples of which include hydroxy, amino, halo- and alkyl groups.

Examples of the radicals $R^1$, $R^2$ and $R^3$ of Formula I above are methyl, ethyl, propyl, nonyl, dodecyl, isobutyl, phenyl, hydroxy-phenyl, dodecyl phenyl, benzyl and 4-hydroxy-3,5-dimethylphenyl. It is preferred that at least one of $R^1$, $R^2$ and $R^3$ radicals be aryl or aralkyl and most preferably, each of said radicals is aryl, such as for example phenyl or p-chlorophenyl.

Examples of X, the acid anion, in Formula I above, are chloride, bromide, iodide and sulfate, the first mentioned being preferred.

Sulfonium salts and methods for their preparation are known. For example, they can be prepared by the reaction of an aromatic hydrocarbon with a sulfur monohalide in the presence of anhydrous aluminum chloride and a halogen.

If desired, a sulfonium salt, other than halide, can be used. Salts such as the acetate can be readily obtained from the halides by simply passing an aqueous solution of the available sulfonium salt usually the chloride, for example a 50% solution of triphenylsulfonium chloride, through an appropriate ion exchange medium. Thus, the acetate can be readily obtained by using a strong base resin such as Rohm and Haas IRA 400.

The other essential component of the inhibitor combination is a dithiocarbamic acid derivative of the formula:

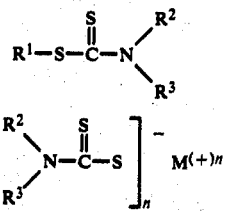

II-a

II-b wherein $R^1$, $R^2$ and $R^3$ are each hydrogen or a hydrocarbon radical such as for example alkyl, alkenyl, alkynyl, aryl, alkaryl, aralkyl, or a cyclic, polycyclic or heterocyclic group. $M^{(+)n}$ represents a metal cation preferably an alkali metal, e.g. sodium or potassium, an ammonium or a heavy metal multi valent cation such as lead, zinc, cadmium, antimony and the like in which case a single cation is associated with two anion moieties, n is 1 to 3. One of $R^2$ or $R^3$ in Formula II-b above may also be a dithiocarboxyl alkyl group in which case the dithiocarbamic acid salt is an alkylene bis-dithiocarbamate preferably the alkylene moiety is lower alkylene, e.g. methylene, ethylene or propylene. Also included within the scope of the Formula II are compounds wherein the radicals $R^1$, $R^2$ and $R^3$ contain one or more of the same or different substituents, examples of which include hydroxy, amino, halo- and alkyl groups. Examples of the radicals $R^1$, $R^2$ and $R^3$ are methyl, ethyl, isopropyl, octadecyl, dodecyl, decenyl, benzyl, phenyl, naphthyl, cyclopentyl, cyclohexyl, thiazolyl, abietyl, pyridyl, quinolyl, the group

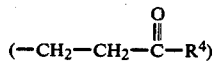

wherein $R^4$ is alkyl, aryl or alkaryl preferably lower alkyl.

The preferred dithiocarbamic acid components are the N-substituted esters, particularly, the alkyl or aralkyl esters of N-alkyl and N,N-dialkyl dithiocarbamic acid preferably benzyl-N-methyl dithiocarbamate.

The dithiocarbamic acid derivatives suitable for use as the dithiocarbamate component of the inhibitor composition are known materials which are either available commercially or can be prepared in accordance with procedures known in the literature.

The thioureas with which the inhibitor combination of this invention is effective are those which have been found useful in acid cleaning of industrial equipment, such as, boilers and particularly those which function as copper complexing agents. The thiourea compounds used for this purpose can be represented by the following formula:

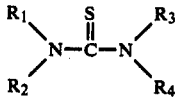

III wherein $R_1$, $R_2$, $R_3$ and $R_4$ are each hydrogen, alkyl, aralkyl, heterocyclic, or aryl groups and may be the same or different. These groups can in turn be substituted by such functional groups as halogen, amino, hydroxy, or common radicals containing nitrogen, oxygen or sulfur. Suitable thioureas of Formula III are for example: thiourea, 1-methylthiourea, 1,3-diethylthiourea, 1-phenylthiourea, 1-phenyl-3(2 hydroxyethyl) thiourea, methylolthiourea and the like.

The thioureas are usually used in acid solutions to be inhibited in concentrations as low as 0.001 gm/liter of acid solution and as high as 100 gms/liter. The particular concentration is determined by the nature of the acid solution, the copper content of the scale to be removed, the temperature at the time of exposure to the metal and other inhibitors used in making inhibitor blends. A commonly used industrial cleaning solution has about 7% (wt/wt) hydrochloric acid and about 1% (wt/vol) thiourea.

In treating metal surfaces of industrial equipment to remove relatively insoluble incrustations which develop during normal operation, the inhibitor composition of this invention can be conveniently used by adding it to the acid cleaning solution used in the customary manner. The acid solution is generally selected in accordance with the nature of the incrustations with the non-oxidizing acids and especially the inorganic non-oxidizing acids being preferred. Hydrochloric, sulfuric or phosphoric are the particular acids most commonly used. Hydrochloric acid is generally used at a concentration of between 5 to 25% by weight; sulfuric at a concentration of about 5 to 15% by weight and phosphoric at about 10 to 25% by weight. Higher or lower concentrations of these acids are also used depending upon specific conditions and type of acid treatment involved. For example oil well acidizing may utilize hydrochloric acid at concentrations of 30% by weight or higher whereas pickling operations may utilize concentrations as low as about 1% acid by weight in the bath. Aqueous solutions of hydrochloric acid preferably at a concentration of about 5 to about 10% by weight are most frequently used in cleaning heating equipment and the like and the use of the inhibitor combination of this invention will be described with particular reference to such cleaning operations though it is to be understood that the combination will find use in other acid treating situations of the type described above and elsewhere herein, whenever attack on the basis metal is a problem and particularly when thiourea or a thiourea derivative is used with the acid. Typical of cleaning treatments with hydrochloric acid to which a urea derivative has been added is the process described in U.S. Pat. No. 2,959,555 and the combination of this invention is particularly well suited to use in such processes.

In general, the combination of this invention is used by adding to either the diluted or concentrated hydrochloric acid a formulated composition containing the two essential ingredients, preferably in solution in a suitable solvent, though a dry formulation can also be used. In the latter case, the formulation can also be readily combined with the urea derivative preferably thiourea. In any case, the inhibitor composition should be added and thoroughly mixed with the acid by stirring or agitating. The inhibited solution is conveniently used by circulating it through the equipment to be cleaned. If circulation cannot be accomplished, the equipment should be filled with the inhibited acid and allowed to react with the scale and incrustations for sufficient time to remove the objectionable deposits. To estimate the proper acid concentration and cleaning time, samples of the deposits to be removed can be tested in the laboratory prior to the cleaning operation. If desired, the equipment to be cleaned or the acid cleaning solution or both can be heated to speed the cleaning action. In such case, the heating is preferably done prior to beginning the cleaning operation and generally a greater amount of inhibitor composition is used at higher temperatures. As in the case of selecting an appropriate acid concentration and cleaning time, the cleaning temperature can be chosen by testing with a representative sample of the metal and deposits to be cleaned. The amount of inhibitor used can also be determined by similar testing. For guidance, however, it has been found that when using a 5% hydrochloric acid solution (14.1% by volume of 20° Baumé hydrochloric acid) for cleaning at a temperature of about 150° F. effective inhibition can be obtained by using about 0.2 gms/l triphenylsulfonium chloride and about 0.1 gms/l of benzyl-N-methyl dithiocarbamate. Greater amounts can be used though generally there is little increase of inhibiting strength by increasing inhibitor concentration significantly above the effective concentration for any given temperature and acid concentration. In practice, it is preferred to use the inhibitor blend in an amount sufficient to provide at least about 0.008% by wt. of triphenylsulfonium chloride and at least about 0.003% by weight of benzyl-N-methyl dithiocarbamate in the working bath. Greater amounts are required for higher temperatures. Generally for each 25° F. increase in temperature above 150° F. there is required an additional amount of inhibitor equivalent to the amount found to be effective at about 150° F. The length of time required to remove the undesirable deposits will depend upon the effectiveness of the acid dissolution of the incrustations or scale and the solution is generally allowed to remain in the system until the metal surface is free of unwanted deposits or until the action of the acid stops.

The amount of sulfonium salt and dithiocarbamate inhibitors used to provide the effective acid inhibitor of this invention can be varied over a wide range, depending upon the particular acid used in the cleaning solution, the basis metal, the temperature and other factors.

The ratio in which the two essential components are utilized does not appear to be critical and the proportions can also be varied over a wide range. There can be used about 0.1 to about 2.0 parts by weight of dithiocarbamate, e.g. benzyl-N-methyl dithiocarbamate, for each part by weight of sulfonium salt, e.g. triphenylsulfonium chloride. Generally, it is preferred that there be used a greater amount by weight of sulfonium salt than dithiocarbamate. Preferably, compositions having about 2.5 parts by weight of triphenylsulfonium chloride for each part by weight of benzyl-N-methyl dithiocarbamate have been found to be particularly effective in hydrochloric acid/thiourea systems.

The inhibitor combination of this invention can be added to the cleaning solution as separate additives or can be conveniently formulated in a concentrated inhibitor composition in liquid or dry form along with the usual formulating ingredients.

Generally, in formulating the inhibitor compositions of this invention, the amounts of essential inhibiting ingredients in the formulation will comprise about 10 to 80% by wt. of the total formulated concentrate; the remainder consisting of solvent preferably butyl cellosolve and other conventional formulated ingredients. The product can also be supplied as dry powder formulation along with other ingredients or as a dry formulation it can have nearly 100% active ingredients, i.e. essential only sulfonium salt and dithiocarbamate.

By way of illustration a formulated composition containing as the essential inhibitor composition a mixture of triphenyl sulfonium chloride and benzyl-N-methyl dithiocarbamate can be easily prepared by blending the essential ingredients in a water miscible solvent along with other additives generally employed in formulating inhibitor compositions. As solvent, there can be utilized any water miscible solvent in which the two essential components are soluble and which is stable to the acid cleaning solution in use. Suitable additives include materials which increase acid solubility of the composition and oil dissolution. Other additives known to the art may be included to get a homogeneous concentrate and to aid in solubilization of the essential components. In general, these additives are surface active agents and solvents for the other components comprising the composition. Other ingredients such as anti-foaming agents, diluents to adjust the volume, buffers to adjust pH and the like which are typically utilized in formulating may be included and are intended to come within the scope of this invention.

Any surface active agent compatible with the other components of the composition can be used including anionic, cationic and nonionic surface active agents with the nonionic being preferred. Examples of such nonionic surface active agents are the ethoxylated secondary alcohols and ethoxylated nonyl phenols. Among the surfactants that are particularly suitable in formulating the inhibitor compositions of this invention, there can be mentioned the following: Igepal CO-850 available from the Gaf Corp.; Makon 20 available from Stepan Chemical, Retzanol NP200 manufactured by Retzloff; Surfonic N200 manufactured by Jefferson; T Det N20 manufactured by Thompson Hayward and Tergitol NP40 manufactured by Union Carbide Corporation.

In addition to the formulating additives indicated above, the essential inhibitor ingredients of this invention can be combined with other inhibitors which may also contain other additive materials or they can be formulated along with such other inhibitors as an additional active ingredient. Other inhibitors that may be blended with the synergistic combination of sulfonium salt and dithiocarbamic acid derivative include for example propargyl alcohol, ammonium thiocyanate, mercapto benzothiazole, the Mannich bases and the like.

In still another embodiment, the inhibitor complex of this invention, which is particularly useful for reducing the basis metal attack of hydrochloric acid/thiourea cleaning solutions can be formulated by combining the inhibitor composition with the thiourea to provide a single additive to hydrochloric acid thereby facilitating make-up of the inhibited hydrochloric acid/thiourea cleaning solution.

The combination when used with a conventional hydrochloric acid/thiourea cleaning solution provides a substantial reduction in basis metal loss as compared to acid corrosion inhibitors presently employed in such acid cleaning solutions. The reduction in metal loss achieved by using this combination of inhibitors, particularly, in the case of mild steel is significantly greater than can be achieved with either inhibitor separately.

In utilizing the composition of this invention to inhibit acid attack on metal, the combination is preferably added to the particular acid composition as the formulated concentrate utilized in an amount sufficient to inhibit attack of the particular acid on the metal which is exposed thereto. The amount of inhibiting composition that is indicated will vary depending upon a number of factors, some of which can be readily controlled including the concentration of the acid and the temperature at which the operation is conducted. Generally, the amount of inhibitor to be utilized at high temperature is greater; likewise, the amount to be utilized at higher acid concentrations is greater. The range of inhibitor concentrations over which the degree of inhibition varies significantly with increase or decrease in inhibitor concentration at a given temperature is relatively narrow. So also the range of inhibitor concentration over which the degree of inhibition varies for any given cleaning acid concentration is relatively narrow. Generally, however, for most industrial cleaning operations, the amount of inhibitor combination in accordance with this invention will be at least about 0.01% by volume and usually between about 0.1% and about 1.0 preferably 0.1 to 0.25% based upon a ratio of about 2.5 parts of triphenylsulfonium chloride for each part of benzyl-N-methyl dithiocarbamate utilized at a temperature in the range of about 150° F. to about 200° F.

When used in a conventional hydrochloric acid/thiourea solution of 5 to 10% by weight hydrochloric acid and about 1% thiourea by weight in solution, inhibitor compositions containing about 20 to 50% by weight, preferably 20 to 30% by weight, of active ingredients (sulfonium salt and dithiocarbamate) is used in an amount sufficient to provide at least about 0.05% by volume of inhibitor in the cleaning solution.

In view of the various applications and the wide range of conditions under which the inhibitor of this invention can be used, it is to be understood that the effective amount and conditions of use for any particular situation is best determined from experience gained in using the composition in such particular application. The amounts provided herein as well as the particular proportion of essential components and other ingredients is given for guidance purposes.

The inhibitor compositions of this invention while best suited for inhibiting the attack of hydrochloric acid in the presence of thiourea can also be employed in applications where acid inhibitors are generally utilized, for example, in metal pickling operations and oil well acidizing processes. While particularly effective results have been obtained with the inhibitor combination in treatment of ferrous metals, particularly mild steel, the inhibitor combination can also be utilized to protect against acid attack on other metals such as copper, brass, stainless steel and other alloys. As will become evident from the examples which follow, the particular synergistic effect obtained with the inhibitor combination provides a special advantage in the case of hydrochloric acid/thiourea cleaning. However, the high degree of inhibiting power provided by the combination makes it suitable for a multitude of applications.

EXAMPLE 1

Preparation of Benzyl-N-Methyl Dithiocarbamate

Benzyl-N-methyl dithiocarbamate, which is representative of the dithiocarbamates suitable for use in the compositions of this invention, is a commercially available product. If desired, it can also be prepared from readily available starting materials and the entire reaction product can be used in formulating the inhibitor composition. A suitable method for preparing benzyl-N-methyl dithiocarbamate is as follows:

Into a 300 ml 3-neck flask fitted with a thermometer, stirrer and condenser, is placed 13.7 gms of carbon disulfide and 12.2 gms mono methyl amine hydrochloride dissolved in 20 mls water. The mixture is stirred and cooled to 10°-15°. 14.4 gms sodium hydroxide dissolved in 32 mls of water is slowly added over 30 minutes. Stirring is continued and the mixture is warmed at 75°-85° C. for 1 to 2 hours.

The mixture is then cooled and 22.9 gms of benzyl chloride in 100 mls of acetone is added. This mixture is heated to a gentle reflux for 1 to 2 hours.

The acetone is distilled off.

100 mls of water is added to dissolve any precipitated sodium chloride.

The contents of the flask are then placed into a separatory funnel and the product is extracted from the bottom as an "oil-like" substance which is drained into a Petri dish and allowed to crystallize.

After solidifying, the benzyl-N-methyl dithiocarbamate product is broken up and used "as is" in preparing the inhibitor formulations. Other dithiocarbamate products can be prepared by analgous procedure also using known, available starting materials. The reaction products can be used as is in formulating the corresponding inhibitor compositions.

EXAMPLE 2

An inhibitor composition was prepared with ingredients in the following amounts:

| Ingredient | grams/ liter | % by Wt. |
|---|---|---|
| Butyl Cellosolve | 495.2 | 48.11 |
| Benzyl-N-Methyl Dithiocar- | 67.8 | 6.59 |

-continued

| Ingredient | grams/ liter | % by Wt. |
|---|---|---|
| bamate | | |
| Glacial Acetic Acid | 67.8 | 6.59 |
| Igepal CO-850 (Gaf Corp., N.Y., N.Y.) | 67.8 | 6.59 |
| Triphenyl Sulfonium Chloride-50% | 325.3 | 31.60 |
| 66° Be Sulfuric Acid | 5.4 | 0.52 |
| | 1029.3 | 100.00 |

The composition is prepared by combining the ingredients in a blending vessel equipped with a stirrer. The benzyl-N-methyl dithiocarbamate is first dissolved in the butyl cellosolve. The remainder of the ingredients are then added in the order listed, while stirring. Stirring is continued until a homogeneous mixture is obtained. The final product is a clear liquid. The mixture is preferably filtered to remove unwanted impurities which may be carried in with the starting materials. The clear liquid composition has a specific gravity of 1.029±0.005 at 60° F. before putting it into containers for shipment.

EXAMPLE 3

This example illustrates formulations having different concentration and ratio of ingredients than that of Example 2. The components were combined in a similar manner.

Formula A

| Ingredient | grams/ liter | % by Wt. |
|---|---|---|
| Benzyl-N-Methyl Dithiocarbamate | 100.0 | 9.20 |
| Butyl Cellosolve | 298.4 | 27.47 |
| Glacial Acetic Acid | 100.0 | 9.20 |
| Igepal CO-850 | 100.0 | 9.20 |
| Triphenyl Sulfonium Chloride-50% | 480.0 | 44.19 |
| 66° Be' Sulfuric Acid | 8.0 | 0.74 |
| | 1086.4 | 100.00 |

Formula B

| | |
|---|---|
| 0.6 gms | Benzyl-N-Methyl Dithiocarbamate |
| 3.0 gms | Butyl Cellosolve |
| 1.0 gms | Glacial Acetic Acid |
| 1.0 gms | Igepal CO-850 |
| 4.8 gms | Triphenylsulfonium Chloride (50%) |
| several drops 66° Be' Sulfuric Acid | |

Formula C

| | |
|---|---|
| 1.2 gms | Benzyl-N-Methyl Dithiocarbamate |
| 3.0 gms | Butyl Cellosolve |
| 1.0 gm | Glacial Acetic Acid |
| 1.0 gm | Igepal CO-850 |
| 4.8 gms | Triphenylsulfonium Chloride (50%) |
| 10 to 12 drops 66° Be' Sulfuric Acid | |

EXAMPLE 4

The following formulation was prepared by blending the amounts of ingredients specified below in the same order as they appear.

| | |
|---|---|
| 1.0 gm | Benzyl-N-Methyl Dithiocarbamate |
| 3.0 gms | Butyl Cellosolve |
| 1.0 gm | Glacial Acetic Acid |
| 1.0 gm | Igepal CO-850 (Gaf Corp., N.Y., N.Y.) |
| 4.8 gms | Triphenyl Sulfonium Chloride (50% by wt. in water) |

Upon addition of the triphenyl sulfonium chloride, the solution turned cloudy. A few drops of sulfuric acid (66° Bé) was added and the solution again became clear.

The inhibiting strength of the composition was determined as follows:

A strip of mild steel (1010 cold roll steel) ½ inch wide by 7 inches long is prepared by solvent wiping with acetone on a cotton rag, then bending the strip to a suitable shape for immersion in the test solution, generally an "S" shape. In order to remove all rust, the strip is then pre-pickled for 5 minutes in a 50% by volume solution of concentrated hydrochloric acid (23° Baumé, CP grade) in water. The acid is drained off and the strip is rinsed with tap water several times. The strip is then rinsed in acetone, acetone is poured off, and the strip is blotted dry with a cotton rag. The dried, cleaned strip is weighed and immersed in the test solution of 7% wt/wt hydrochloric acid with 1% thiourea by wt. maintained at a temperature of 150° F. for 6 hours. The strip is then removed from the test solution, rinsed in warm tap water and dipped in acetone. The acetone is dried off and the strip is again weighed to determine the metal loss.

| Inhibitor Concentration* (% vol/vol) | Benzyl-N-Methyl Dithiocarbamate Concentration (% wt/vol) | Triphenyl Sulfonium Chloride Concentration (% wt/vol) | Wt. Loss (lbs/sq ft/24 hr)** |
|---|---|---|---|
| .105 | .010 | .025 | .0057 |
| .210 | .021 | .050 | .0060 |

*Concentration is for the amount of formulated composition added to the test solution.

**The weight loss in grams as measured in the test is converted to weight loss in lbs/sq ft/24 hours by multiplying the weight loss in grams times 0.181. For industrial chemical cleaning, it is preferred that weight loss not exceed 0.005 lbs/sq ft/24 hours.

EXAMPLE 5

To illustrate the improvement in inhibiting strength provided by the sulfonium salt and dithiocarbamate mixture, a corrosion inhibitor composition of the type sold commercially for industrial cleaning with hydrochloric acid was prepared and tested in hydrochloric acid solutions with and without thiourea. The corrosion inhibitor was prepared by combining a rosin amine inhibitor of the type disclosed in U.S. Pat. No. 2,758,970 with triphenylsulfonium chloride and propargyl alcohol.

Such inhibitors are available for example under the brand name Rodine sold by Amchem Products, Inc. A typical inhibitor of this type has the following approximate composition:

| Ingredient | % by wt. |
|---|---|
| Rosin Amine Derivative prepared from Rosin Amine D (sold by Hercules, Inc. of Wilmington, | 59.0 |

-continued

| Ingredient | % by wt. |
|---|---|
| Delaware) acetophenone, acetone, HCl and formaldehyde. | |
| Igepal CO-850 (available from Gaf Corp., New York, N.Y.) | 30.0 |
| Isopropanol | 6.0 |
| Propargyl Alcohol | 2.5 |
| Triphenylsulfonium Chloride (50% by wt.) | 2.5 |
| | 100.0% |

EXAMPLE 6

An inhibitor composition in accordance with Example 5 was tested for corrosion inhibition as described in Example 4 using a 7% hydrochloric acid test solution maintained at 150° F. for 6 hours. Thiourea was added in amounts as indicated in Table I.

TABLE I

| Inhibitor Composition of Example 5 Concentration (% vol/vol)* | Thiourea Concentration (% wt/vol) | Wt. Loss (lb/sq ft/24 hrs.) |
|---|---|---|
| 0.1 | None | .0017 |
| 0.2 | " | .0014 |
| 0.3 | " | .0016 |
| 0.4 | " | .0014 |
| 0.1 | 1.0 | .0213 |
| 0.2 | " | .0175 |
| 0.3 | " | .0155 |
| 0.4 | " | .0156 |

*Concentration is for the amount of formulated composition added to the test solution.

EXAMPLE 7

This example shows the greatly improved inhibiting power of the compositions of Examples 1 and formula A of 3 as compared to the prior art compositions of Example 5 in a hydrochloric acid and thiourea cleaning solution. The tests were carried out as in Example 4 above using as test solution hydrochloric acid cleaning compositions containing thiourea or a thiourea derivative as a copper complexing agent in amounts as indicated. The concentration of hydrochloric acid was 7% (wt/wt). The test was done at 150° F. for 6 hours. The results are as shown in Table II.

TABLE II

| Inhibitor Cmposition | Inhibitor Concentration (% vol/vol)* | Thiourea Concentration (% wt/vol) | Wt. Loss (lbs/sq ft/24 hrs.) |
|---|---|---|---|
| Example 5 | 0.1 | 1.0 (.0263 moles/liter) | .0237 |
| Example 4 | 0.1 | 1.0 (.0263 moles/liter) | .0056 |
| | | Methylol Thiourea | |
| Example 5 | 0.1 | 1.39 (.0263 moles/liter) | .0079 |
| Example 4 | 0.1 | 1.39 (.0263 moles/liter) | .0035 |

TABLE II-(a)

| Formulation | Inhibitor Concentration (% vol/vol)* | Thiourea Concentration (% wt/vol) | Temp | lbs/ft$^2$ 24 hours |
|---|---|---|---|---|
| Example 5 | 0.1 | 1.0 | 150° F. | .0213 |

TABLE II-(a)-continued

| Formulation | Inhibitor Concentration (% vol/vol)* | Thiourea Concentration (% wt/vol) | Temp | lbs/ft$^2$ 24 hours |
|---|---|---|---|---|
| Example 3-A | 0.1 | 1.0 | 150° F. | .0060 |
| Example 2 | 0.1 | 1.0 | 150° F. | .0083 |
| Example 2 | 0.15 | 1.0 | 150° F. | .0057 |
| Example 5 | 0.1 | None | 175° F. | .0024 |
| Example 3-A | 0.1 | None | 175° F. | .0046 |
| Example 2 | 0.1 | None | 175° F. | .0060 |
| Example 2 | 0.15 | None | 175° F. | .0045 |

*Concentration is for the amount of formulated composition added to the test solution.

EXAMPLE 8

This example demonstrates the synergistic corrosion inhibiting effect of the triphenyl sulfonium salt and dithiocarbamate combination. The tests were carried out as in the preceding examples using amounts of test compositions as indicated in Table III. The tests were done with 7% wt/wt hydrochloric acid solutions maintained at 150° F. for 6 hours. For comparison, the triphenylsulfonium chloride was formulated without the dithiocarbamate by substituting an equal weight amount of butyl cellosolve for the dithiocarbamate. This formulation identified as Formulated TPSC has the following compositions:

| | |
|---|---|
| Butyl Cellosolve | 4.0 gms |
| Glacial Acetic Acid | 1.0 gm |
| Igepal CO-850 | 1.0 gm |
| Triphenylsulfonium Chloride (50%) | 4.8 gms |
| 2 drops 66° Be' Sulfuric Acid | |

TABLE III

| Inhibitor | Concentration | Thiourea Concentration (gms/l) | Wt. Loss (lbs/sq ft/24 hrs.) |
|---|---|---|---|
| triphenylsulfonium chloride (50%) | 0.5 ml/l | 10.0 | .0108 |
| triphenylsulfonium chloride (50%) | 1.0 ml/l | 10.0 | .0077 |
| benzyl-N-methyl dithiocarbamate | 1.0 gm/l | 10.0 | .7649 |
| benzyl-N-methyl dithiocarbamate | .5 gm/l | 10.0 | .7414 |
| Formulated TPSC | 1.05 ml/l* | 10.0 | .0120 |
| Formulated TPSC | 2.10 ml/l* | 10.0 | .0171 |
| Formulation of Example 4 | 1.05 ml/l* | 10.0 | .0057 |
| Formulation of Example 4 | 2.10 ml/l* | 10.0 | .0060 |

*Concentration is for the amount of formulated composition added to the test solution.

EXAMPLE 9

This example illustrates the use of the inhibitor combination of this invention in conjunction with another inhibitor. The tests were carried out as in the preceding examples using 1% wt/vol thiourea in a 7% wt/wt hydrochloric acid solution at 150° F. for 6 hours. The weight loss results are shown in Table IV.

TABLE IV

| Inhibitor Combination | Concentration of Inhibitors | Weight Loss (lbs/sq ft/24 hrs.) |
|---|---|---|
| Triphenylsulfonium chloride (50% by wt) | 1.0 ml/l | .0041 |
| Zinc dimethyl dithiocarbamate | 0.05 gm/l | |
| Mercaptobenzothiazole | 0.45 gm/l | |
| Triphenylsulfonium chloride (50% by wt) | 0.5 ml/l | .0074 |
| Mercaptobenzothiazole | 0.5 gm/l | |
| Benzyl-N-methyl dithiocarbamate | 0.5 gm/l | |

EXAMPLE 10

This example illustrates the inhibiting power of the combination with change in the ratio of amount of triphenylsulfonium salt to the amount of dithiocarbamate. Tests were carried out in the same manner as above using 7% (wt/wt) hydrochloric acid with 1% (wt/vol) thiourea at 150° F. for 6 hours. Results are shown in Table V.

TABLE V

| Inhibitor | Concentration | Wt. Loss (lbs/sq ft/24 hrs.) |
|---|---|---|
| Triphenylsulfonium Triphenylsulfonium chloride (50% by wt) | 1.0 ml/l | .0071 |
| Benzyl-N-methyl dithiocarbamate | 1.0 gm/l | .7649 |
| Triphenylsulfonium chloride (50% by wt) | 0.5 ml/l | .0094 |
| Benzyl-N-methyl dithiocarbamate | 0.5 gm/l | .7414 |
| Triphenylsulfonium chloride (50% by wt) | 0.5 ml/l | .0060 |
| Benzyl-N-methyl dithiocarbamate | 0.5 gm/l | |
| Triphenylsulfonium chloride (50% by wt) | 1.0 ml/l | .0058 |
| Benzyl-N-methyl dithiocarbamate | 0.5 gm/l | |

EXAMPLE 11

This example illustrates the use of various dithiocarbamates with substantially equal effectiveness in inhibiting corrosion. The formulations used are given and the results of tests are shown in Table VI. The test method is the same as in previous examples using 7% hydrochloric acid (wt/wt) at 150° F. for 6 hours.

Formulation A 0.1 gm Zinc dimethyl dithiocarbamate
0.9 gm Mercaptobenzothiazole
3.5 gm Butyl cellosolve
1.0 gm Igepal CO-850 (Gaf Corp.)
1.0 gm Hydrochloric acid (20° Baumé)
4.8 gm Triphenylsulfonium chloride (50% by wt.)

Formulation B 1.0 gm Sodium diethyl dithiocarbamate
2.3 gm Butyl cellosolve
1.0 gm Igepal CO-850 (Gaf Corp.)
4.8 gm Triphenylsulfonium chloride (50% by wt.)
2.0 gm Hydrochloric acid (20° Baumé)

TABLE VI

| Formulation | Inhibitor Concentration* (% vol/vol) | Thiourea | Wt. Loss (lbs/sq ft/24 hrs.) |
|---|---|---|---|
| A | .105 | 1% wt/vol | .0102 |
| B | .105 | 1% wt/vol | .0080 |
| A | .105 | None | .0032 |
| B | .105 | None | .0027 |

*The concentration is for the amount of formulated composition added to the test solution.

EXAMPLE 12

This example illustrates the inhibiting power at various concentrations of the synergistic combination of triphenylsulfonium chloride and benzyl-N-methyl dithiocarbamate (Example 4). Test procedures are the same as in previous examples using 7% hydrochloric acid (wt/wt) with 1% thiourea (wt/vol) at 150° F. for 6 hours. Results are shown in Table VII.

TABLE VII

| Formulation | Inhibitor Concentration* (% vol/vol) | Thiourea Concentration (% wt/vol) | Wt. Loss (lbs/sq ft/24 hrs.) |
|---|---|---|---|
| Example 4 | .1 | 1 | .0058 |
| Example 4 | .075 | 1 | .0063 |
| Example 4 | .050 | 1 | .0093 |
| Example 4 | .025 | 1 | .0129 |

*The concentration given is for the amount of formulated composition added to the test solution.

I claim:

1. A process for cleaning industrial equipment, having water scale or other undesirable water insoluble deposits, with an aqueous hydrochloric acid cleaning solution wherein said acid solution is inhibited from attacking the basis metal of the industrial equipment by including in said cleaning solution an inhibitor combination consisting essentially of:

(a) a compound of the formula:

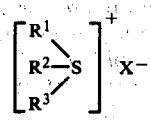

wherein $R^1$, $R^2$, and $R^3$ are each a hydrocarbon radical or substituted hydrocarbon radical selected from the group consisting of methyl, ethyl, propyl, nonyl, dodecyl, isobutyl, phenyl, hydroxyphenyl, dodecylphenyl, benzyl, 4-hydroxy-3,5-dimethylphenyl and p-chlorophenyl and wherein X is an anion selected from the group consisting of chloride, bromide, iodide and sulfate; and, (b) a compound of the formula:

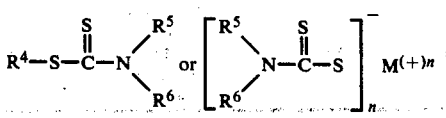

wherein $R^4$, $R^5$ and $R^6$ are each hydrogen or a hydrocarbon or substituted hydrocarbon radical selected from the group consisting of methyl, ethyl, isopropyl, octadecyl, dodecyl, decyl, benzyl, phenyl, naphthyl, cyclopentyl, cyclohexyl, thiozolyl, abietyl, pyridyl, quinolyl and $$-CH_2-CH_2-\overset{\overset{\displaystyle O}{\|}}{C}-R^7$$

wherein $R^7$ is lower alkyl, and M is a cation selected from the group consisting of sodium, potassium, ammonium, lead, zinc, cadmium and antimony and wherein n is 1 to 3, said inhibitor combination being present in an amount sufficient to produce effective inhibition of basis metal attack by said acid solution with the proviso that from 0.1 to about 2.0 parts by weight of component (b) be present per part by weight of component (a).

2. The process of claim 1 wherein the inhibitor combination is triphenyl sulfonium chloride in an amount of at least about 0.008% by weight and benzyl-N-methyl dithiocarbamate in an amount of at least about 0.003% by weight.

3. The process of claim 1 wherein the acid cleaning solution also contains a copper complexing agent selected from the group consisting of thiourea, methylol thiourea, 1-methylthiourea, 1,3-diethylthiourea, 1-phenylthiourea, and 1-phenyl-3(2-hydroxyethyl)thiourea in an amount sufficient to provide at least about 0.001 gram per liter in solution.

4. The process of claim 3 wherein the copper complexing agent is thiourea.

5. The process of claim 3 wherein the copper complexing agent is methylol thiourea.

* * * * *

UNITED STATES PATENT AND TRADEMARK OFFICE

CERTIFICATE OF CORRECTION

PATENT NO. : 4,180,469

DATED : December 25, 1979

INVENTOR(S) : James D. Anderson

It is certified that error appears in the above-identified patent and that said Letters Patent are hereby corrected as shown below:

On the cover page of the patent, in the lines identified by "[73] Assignee:", for "New York, N.Y." read --Ambler, Pa.--.

Column 15, line 31, delete "Triphenylsulfonium"

Signed and Sealed this

*Twenty-ninth* Day of *July 1980*

[SEAL]

*Attest:*

SIDNEY A. DIAMOND

*Attesting Officer*

*Commissioner of Patents and Trademarks*